US006749146B1

(12) United States Patent
Madrzak et al.

(10) Patent No.: US 6,749,146 B1
(45) Date of Patent: Jun. 15, 2004

(54) PROCESS AND APPARATUS FOR THREADING A MATERIAL WEB ONTO A REEL

(75) Inventors: Zygmunt Madrzak, Heidenheim (DE); Matthias Wohlfahrt, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/533,978

(22) Filed: Mar. 23, 2000

(30) Foreign Application Priority Data

Mar. 24, 1999 (DE) ..... 199 13 219

(51) Int. Cl.[7] ..... B65H 35/08
(52) U.S. Cl. ..... 242/526.3
(58) Field of Search ..... 242/526.3, 532.7

(56) References Cited

U.S. PATENT DOCUMENTS

| | | | | | |
|---|---|---|---|---|---|
| 2,385,691 | A | * | 9/1945 | Corbin et al. | 242/521 |
| 3,756,527 | A | | 9/1973 | Collins et al. | |
| 4,387,841 | A | | 6/1983 | Hawkins | |
| 5,014,924 | A | * | 5/1991 | Nowisch et al. | 242/56 R |
| 5,215,008 | A | * | 6/1993 | Kartovaara et al. | 100/47 |
| 5,264,035 | A | * | 11/1993 | Beisswanger et al. | 118/126 |
| 5,354,007 | A | * | 10/1994 | Fissmann et al. | 242/532.7 |
| 5,673,870 | A | * | 10/1997 | Fielding et al. | 242/542.3 |
| 5,690,298 | A | * | 11/1997 | Ruck | 242/542.3 |
| 5,782,426 | A | * | 7/1998 | Kinnunen et al. | 242/526.3 |
| 5,842,664 | A | * | 12/1998 | Akerlund | 242/526.3 |
| 5,954,291 | A | | 9/1999 | Meinecke et al. | |
| 6,022,452 | A | * | 2/2000 | Caspar | 162/286 |
| 6,045,085 | A | * | 4/2000 | Andersson et al. | 242/532.3 |
| 6,129,305 | A | * | 10/2000 | Moller et al. | 242/541 |
| 6,149,099 | A | | 11/2000 | Meinecke et al. | |
| 6,250,580 | B1 | * | 6/2001 | Madzrak et al. | 242/533.2 |
| 6,325,320 | B1 | | 12/2001 | Möller et al. | |
| 6,332,587 | B1 | | 12/2001 | Möller et al. | |

FOREIGN PATENT DOCUMENTS

| | | | | |
|---|---|---|---|---|
| DE | 2411238 | | 9/1974 | |
| DE | 3100814 | | 7/1982 | |
| DE | 3924897 | | 2/1991 | |
| DE | 4401959 | | 7/1994 | |
| DE | 19744505 | | 4/1999 | |
| DE | 19807897 | | 8/1999 | |
| DE | 19860734 | | 9/1999 | |
| DE | 19848806.8 | | 4/2000 | |
| DE | 19848810.6 | | 4/2000 | |
| DE | 19848816.5 | | 4/2000 | |
| DE | 199 07 550 | * | 8/2000 | B65H/19/28 |
| DE | 19907550.6 | | 8/2000 | |
| EP | 0089304 | | 9/1983 | |
| EP | 658504 | | 6/1995 | |
| EP | 664267 | | 7/1995 | |
| EP | 997415 | | 5/2000 | |
| EP | 997416 | | 5/2000 | |
| WO | 92/06913 | | 4/1992 | |
| WO | 96/37429 | | 11/1996 | |

OTHER PUBLICATIONS

"Wochenblatt für Papierfabrikation" (Paper Manufacturing Weekly) 123, 1995, No. 4, pp. 5.

* cited by examiner

*Primary Examiner*—Donald P. Walsh
*Assistant Examiner*—Joseph Rodriguez
(74) *Attorney, Agent, or Firm*—Greenblum & Bernstein, P.L.C.

(57) ABSTRACT

Process and apparatus for threading a material web onto a reel. The process includes guiding a leader strip of the material web over at least a part of a circumference of a support drum, guiding the leader strip through an effective region of a guide device toward a waste receptacle, widening the leader strip to a desired width of the material web, placing a reel against the support drum, thereby forming a nip, cutting the material web, and winding the material web onto the reel, thereby forming a wound roll. The apparatus includes a support drum adapted to be at least partially wound around by at least a leader strip of the material web, one of a reel and a wound roll positionable against said support drum to form a nip during a winding process, a waste receptacle positioned after the support drum in a web travel direction, and at least one guide device positioned between the support drum and the waste receptacle.

64 Claims, 5 Drawing Sheets

Fig. 6a
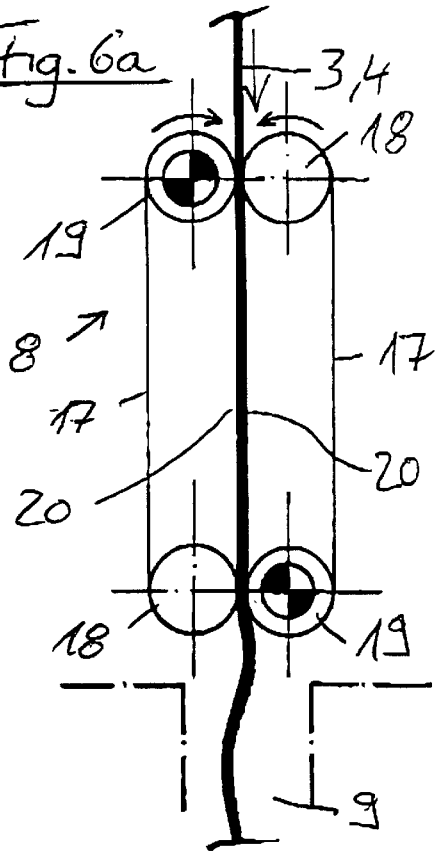
Fig. 6b
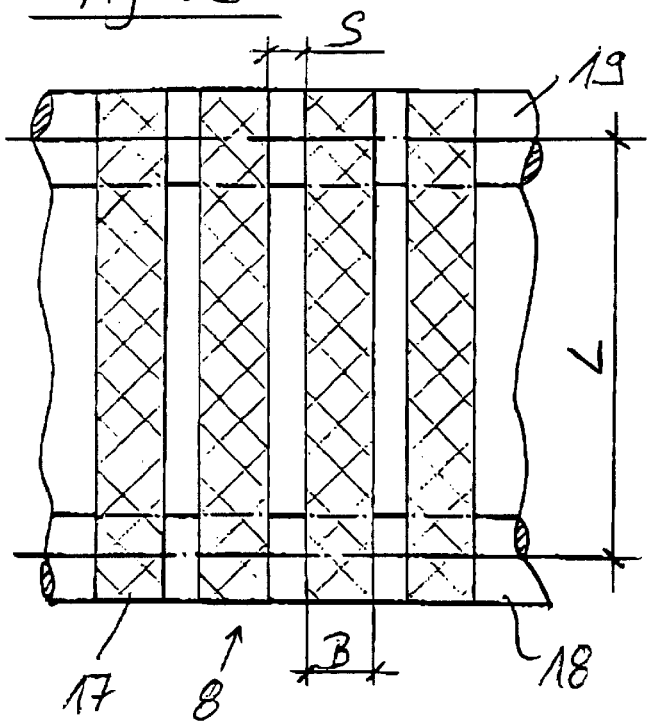
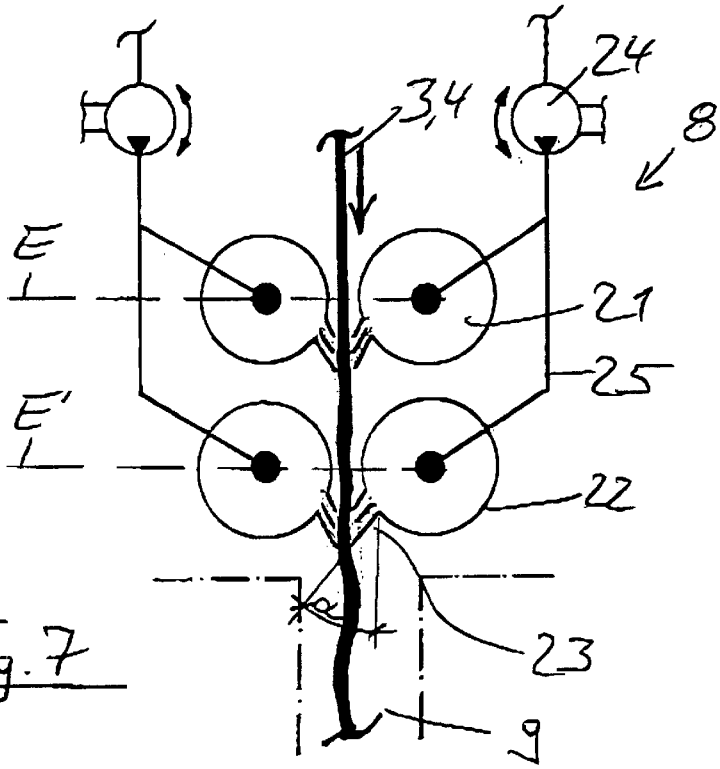
Fig. 7

PROCESS AND APPARATUS FOR THREADING A MATERIAL WEB ONTO A REEL

CROSS-REFERENCE TO RELATED APPLICATIONS

The present application claims priority under 35 U.S.C. §119 of German Patent Application No. 199 13 219.4, filed on Mar. 24, 1999, the disclosure of which is expressly incorporated by reference herein in its entirety.

BACKGROUND OF THE INVENTION

1. Field of the Invention

The present invention relates to a process for threading a material web, e.g., a paper or cardboard web, onto a reel, such as onto an empty or partially wound reel, and a winding machine for threading a material web, e.g., a paper or cardboard web, onto a reel, such as onto an empty or partially wound reel.

2. Discussion of Background Information

Threading of a material web onto a reel is necessary at the beginning of a new winding process with a new, not yet wound reel ("empty reel") or for continuing an already begun winding process after an unintentional or deliberate tearing of the web with a partially wound reel.

It is generally known for the leader strip (e.g., the edge strip of the material web), which comes from a machine for producing or refining a material web and which is guided over a part of the circumference of the support drum, to be threaded immediately onto the reel that forms a nip with the support drum. Only then is the leader strip widened out to the fall material web width. However, the immediate threading of the leader strip onto the reel produces a so-called "winding carrot" with an uneven distribution of the web tension at least in the winding core. Consequently, there is the disadvantage that when the material web is unwound again, the part of the material web that was initially wound on should be discarded as waste. It can also occur, for example, after a stoppage of the production or refining machines, that the material web does not initially have the desired quality and/or production features. In this instance, it is undesirable to wind on an unmarketable part of the material web, instead it should be immediately discarded as waste.

In order to prevent the formation of a "winding carrot" and in order to thread the material web onto the reel only after fulfillment of the desired quality and/or production features, as is also generally known, the leader strip is guided over a part of the circumference of the support drum preceding the reel and is supplied to a waste receptacle ("pulper"). Various waste receptacles are known from a number of published documents for example, from commonly owned European Patent No. EP 0 664 267 B1, from the commonly owned unpublished German Patent Application No. DE 197 44 505.5, and from the special edition of "Wochenblatt fur Papierfabrikation" [Paper Manufacturing Weekly] 123, 1995, No. 4, p. 5. After the leader strip has widened out by being continuously conveyed into the waste receptacle, the incoming material web, which is now fill width, is cut and only then is it threaded onto the reel.

The problem that arises in a process of this kind is that the leader strip or the material web has the tendency to thread itself onto the reel in an undesirable way before being cut ("self-threading"). The tendency of the leader strip or the material web to self thread is influenced by various factors, for example, the nip geometry, the surface form, or the percentage of open areas, the reference hardness, the nip force, and the paper properties. In addition, this problem occurs to a greater extent at high web speeds.

Therefore, attempts have already been made to solve this problem, e.g., as disclosed in the European Patent EP 0 658 504 B1, by forming the support drum preceding the reel as a suction drum. In this regard, a vacuum is produced in the drum, which acts on the material web via corresponding openings in the drum and holds the material web against the drum. A self-threading of the material web onto the reel can in fact be largely prevented. In this way, the vacuum in the support drum impedes the removal of the web in order to convey it into the waste receptacle.

Furthermore, the commonly owned unpublished German Patent Application DE 198 48 816.5 proposes a winding machine for winding a material web onto a reel, in which the material web, supplied by an inlet roll, is guided in conjunction with a perforated support belt over a support drum that can be supplied with suction and a nip is formed between the support drum and the reel. After the support drum, the support belt is guided over an outlet roll, which is disposed in the vicinity of a waste pulper. The leader end of the material web or the entire material web is discarded into the pulper before being subsequently threaded onto the reel. Furthermore, the support drum, which is provided with a perforated jacket and/or with circumference grooves, is externally supplied with suction in the part of its circumference that is not wound around by the perforated support belt and the material web. While this device can also prevent a self-threading of the material web onto the reel, the perforated support belt is subject to wear and must consequently be replaced at certain time intervals. Also, the provision of suction to the support drum, which is expensive to manufacture with its perforated jacket and/or circumference grooves, involves increased operating costs.

Furthermore, reference is also made to the commonly owned unpublished German Patent Application DE 198 48 806.8 with regard to the prior art. This patent application discloses a process for threading a material web onto a reel in which the beginning of the material web to be threaded is wound around a drum preceding the reel and, before being threaded onto the reel, is supplied to a preparation station, such as a waste pulper. In this connection, before being threaded onto the reel, the material web is kept away from the reel via blower air. A device for carrying out the process is also disclosed, which has a blower bar disposed lateral to the web travel direction, having at least one outlet opening for the blower air, a device for conveying blower air to the blower bar and a control device for controlling the introduction of blower air. While this process and this device can also prevent a self-threading of the material web onto the reel to a great extent, the demand for blower air involves increased investment costs and high ongoing operating costs for the disclosed device.

SUMMARY OF THE INVENTION

The present invention provides a process of the type generally discussed above in which the leader strip or the material web is initially conveyed into the waste receptacle in a reliable and controlled manner and in which self-threading of the leader strip or the material web onto the reel, independent of its current position, is substantially prevented. Moreover, the process does not impede the removal of the web from the support drum preceding the reel. The present invention also provides a suitable device for carrying out the process.

The process of the instant invention provides for threading a material web, e.g., a paper or cardboard web, onto a reel, such as an empty or partially wound reel. In particular, the process includes conveying the leader strip over a part of the circumference of the support drum and is then conveying the leader strip through an effective region of a guide device in a direction of a waste receptacle. The leader strip is then widened out to a desired width of the material web. Then, the reel is placed against the support drum, forming a nip between the support drum and the reel. Finally, the material web is cut and the winding of the material web onto the reel to form a wound roll begins.

The above-described process for threading a material web onto a reel, in particular an empty or partially wound reel, can be repeated with each threading of the material web.

A first additional embodiment of the invention provides that, before the leader strip is conveyed to the support drum, the reel is positioned such that a distance of at least approximately 1 mm is provided or maintained between the support drum and the reel. As a result, the leader strip or the material web can be effectively prevented from threading itself onto the reel.

Another embodiment of the invention provides for the effective region to be a contactless region, for example, that includes at least one air flow or at least one water jet. This results in the advantage that no wear occurs due to possible contact between the leader strip or the material web and the device for carrying out the process.

Another embodiment of the invention provides for the effective region to be a contact region, for example, that includes at least one roll or at least one guide belt. This makes it possible for the leader strip or the material web to be conveyed in a controlled manner through the device for carrying out the process.

Another embodiment of the invention provides for the effective region to be formed to act on one side of the leader strip or the material web. This one-sided action produces the advantage that the device for carrying out the process can be embodied in an inexpensive and efficient manner.

In a preferred embodiment of the invention, the effective region can be formed to act on both sides of the leader strip or the material web. This assures a symmetrical and functionally reliable guidance of the leader strip or the material web.

Another embodiment of the invention provides for the effective region to be embodied in different planes on the leader strip or the material web. The planes are oriented perpendicularly to the movement direction of the leader strip or the material web. This results in the leader strip or the material web being guided in a functionally reliable manner over a longer distance.

Preferably, the at least two planes of the effective region that act on both sides of the leader strip or the material web can be arranged offset from one another. This results in the advantage that the deliberate deflection of the leader strip or the material web permits a controlled guidance.

In a particular embodiment of the invention, the leader strip or the material web can be removed from the support drum by a bladed doctor and/or air doctor. In the past, these types of doctors have turned out to be reasonably priced and very reliable with regard to their function. Furthermore, the removal of the leader strip or the material web can occur by producing an overpressure zone in the support drum, which is provided with bores. This overpressure zone in the support drum provides the advantage that there is no element which contacts the outer surface of the support drum to remove the leader strip or the material web, which would have an abrasive action on the outer surface.

There is another advantageous embodiment of the invention when the widening out of the leader strip to a desired width of the material web occurs via a point cutter. This results in the advantage that the cutting process on the leader strip can be carried out with extremely high precision with regard to cutting quality and the like.

A particularly advantageous embodiment of the invention provides for the desired width of the material web to be the entire web width. This makes it possible for a winding that is even across the width of the reel to take place right from the start and to have a uniform diameter increase at the beginning of the winding of the material web into a wound roll on the reel. Thus, the formation of a so-called "winding carrot" can be prevented.

According to another embodiment of the invention, the cutting of the material web takes place passively and/or actively. The passive cutting can take place, for example, through self cutting by the formation of a loop, the active cutting can take place, for example, via a gooseneck, an IBS belt, or a water jet since all of the abovementioned types are distinguished by high reliability, precision, and cost advantages. The active devices for cutting the material web are part of the prior art and are disclosed in, e.g., European Patent Application EP 0 089 304 A1, International Patent Publication No. WO 92/06913, and commonly owned unpublished German Patent Application DE 198 48 810.6, the disclosures of which are expressly incorporated by reference herein in their entireties.

Preferably, the cutting of the material web occurs only after it fulfills at least one desired quality feature and/or production feature. Desired quality features of the material web include, for example, the surface roughness, the shrikage cross-direction profile, and the fiber orientation, whereas desired production features of the material web include, for example, the web speed, the web width, or the production quantity.

Another advantageous embodiment of the invention provides that, before the leader strip is conveyed to the support drum, at least one pressing element is placed against the support drum, e.g., in the vicinity of the path of travel of the leader strip over the support drum, along with the formation of an effective region, for example, a press nip, a press surface, or a blower zone, between the support drum and the pressing element. This achieves the advantage that self-threading of the leader strip or the material web onto the reel, independent of its current position, can be substantially prevented without impeding the removal of the web from the support drum preceding the reel. With regard to other process aspects for the placement of the pressing element against the support drum, reference is made to the commonly owned unpublished German Patent Application 199 07 550.6, the disclosure of which is expressly incorporated by reference herein in its entirety.

Another embodiment of the invention provides for the pressing element to be moved away from the support drum after the beginning of the winding of the material web onto the reel, which forms the wound roll. This results in maintaining the drive power for the support drum at minimal values that assure the operation and, furthermore, the surface wear both on the support drum and on the pressing element can be reduced due to the nonexistence of an effective region.

A winding machine is also provided in accordance with the features of the instant invention. In particular, the winding machine includes at least one guide device for the material web, which is located between the support drum and the waste receptacle. In this manner, the leader strip or the material web is reliably guided into the waste receptacle.

A first embodiment of the invention provides for the guide device to be disposed immediately before the waste receptacle. This achieves the advantage that the leader strip or the material web is reliably guided into the waste receptacle.

In another embodiment of the invention, the guide device can have a width of approximately 1000 mm, preferably of approximately 750 mm, cross-wise (lateral) to the movement direction of the leader strip. This width can be completely sufficient to prevent a self-threading of the leader strip or the material web. Moreover, a pressing element can be provided to hold the leader strip or material web against the support drum. The manufacturing costs of the pressing element can be related to the preferable width of the web, which can be significantly less than the machine width. In addition, the ongoing operating costs for the pressing element are lower.

It may furthermore be advantageous for the guide device to extend across the entire width of the material web. This advantage may particularly come into play if the basis weight of the material web has values over approximately 80 $g/m^2$. This embodiment then assures that the "heavy" material web is guided across the entire width.

It may also advantageous for the guide device to be formed as a roll pair, e.g., as a pair of segmented rolls that are offset in relation to each other and with suitable surface qualities. The segmentation of the rolls produces advantages with regard to friction and strength. Preferably, one roll is embodied as a driven roll. This can lead to an extremely slight possibility of surface friction between the leader strip or the material web and the guide device.

It may also advantageous for the guide device to be formed as a roll pair with at least one perforated roll that is provided with suction. This embodiment makes it possible for the leader strip or the material web to be reliably conveyed into the waste receptacle by the action of adhesive forces in the guide device. It can also be advantageous if the one roll is perforated and provided with suction and the other roll is embodied with a rubber cover. As a result, in addition to the adhesive forces, frictional forces are also produced, making the guidance of the leader strip or the material web even more reliable and effective.

In another embodiment, the guide device can be formed as at least two driven guide belts. Through the structural embodiment of the guide belts with a guide length of approximately 100 to 500 mm, preferably from approximately 200 to 300 mm, and a guide width of approximately 50 to 100 mm, preferably from approximately 70 to 80 mm, the functionally reliable and low-abrasion guidance of the leader strip or the material web through the guide device and into the waste receptacle is achieved. It is also advantageous for the leader strip or the material web to be guided not only in a nip or in a short region, but in a guide segment that has a sufficient guide length. Preferably, a number of guide belts disposed next to one another with a spacing of approximately 20 to 50 mm, preferably approximately 25 to 40 mm, can be used, which can, in turn, be disposed offset in relation to the opposing guide belts, i.e., in the gaps between them. The use of a number of guide belts reduces the belt costs and permits a wear-induced replacement of individual belts. The offset arrangement may result in an even more reliable and effective guidance of the leader strip or the material web.

Another embodiment of the invention provides for the guide device to be embodied as a guidance system that is flowed through by a fluid, and the guidance system can be provided with outlet openings such that the fluid escapes in the direction of the movement direction of the leader strip or the material web, which finally comes into contact with the leader strip or the material web. The above-described embodiment of the guidance system produces a guide device that functions in an abrasion-free manner, which in turn assures a reliable guidance of the leader strip or the material web. In another embodiment, the guidance system is attached on both sides of the leader strip or the material web, which permits an approximately symmetrical guidance. Advantageously, the outlet openings of the guidance system can be positioned in different planes that act cross-wise to the movement direction of the leader strip or the material web. As a result, the guidance of the leader strip or the material web is permitted along a longer guide length with a minimum number of outlet openings. In another embodiment of the invention, the outlet angle of the outlet openings of the guidance system can be adjusted, resulting in the advantage that the forces acting on the leader strip or the material web can be optimized. Advantageously, air or water is used as the fluid flowing through the guidance system. Both fluids assure the functional reliability of the guidance system at justifiable costs when there is an additional adjustability of the pressure of the fluid flowing through the guidance system.

One advantageous embodiment of the invention provides for the guide device to be embodied as a guide surface that is formed by an endless belt that travels between two rolls and is acted upon by a vacuum on a side facing the guide surface. The guide surface produces the advantage that the leader strip or the material web can be reliably and effectively conveyed into the waste receptacle with low investment and operating costs. Preferably, at least one roll is driven, which permits the operating speed to be exactly controlled and optimized.

In another embodiment, the devices that produce the vacuum or overpressure share the common trait that the vacuum or overpressure that is produced can be adjusted. As a result, the operating costs can be optimized with a view to functional reliability.

In a further embodiment of the invention, the guide device can be formed as at least one doctor that acts on the support drum and is provided with at least one blower nozzle which exerts a pressure on the leader strip or the material web in its movement direction. This achieves the advantage that the at least one doctor can remove the leader strip or the material web perfectly from the support drum and the at least one blower nozzle assures the reliable transport of the leader strip or the material web into the waste receptacle, i.e., the functional reliability of the guide device and the runnability of the winding machine of the paper or cardboard machine are assured. Furthermore, the advantage arises that no additional unit has to be built into the winding machine since as a rule, there is a doctor that acts on the support drum. According to the invention, this pre-existing doctor is merely modified.

In another embodiment of the invention, the doctor can have a width of approximately 1000 mm, preferably of approximately 750 mm, cross-wise to the movement direction of the leader strip. This width may be sufficient to prevent a self-threading of the leader strip or the material web. This preferable width, which is also significantly less than the machine width, also permits the manufacturing costs of the doctor to be effectively embodied. In addition, the ongoing operating costs for the doctor are lower.

It is also advantageous for the doctor to extend across the entire width of the material web. This advantage particularly comes into play when the basis weight of the material web has values of over approximately 80 g/m$^2$. This embodiment then assures that the "heavy" material web is guided across the entire width.

With regard to the operation of the doctor, it may also be advantageous for it to have a large number of blower nozzles distributed along its length which, in another embodiment of the invention, may be divided into at least two sections that can be acted on by different pressures. This achieves the fact that the doctor, which functions as a guide device, can best fulfill the demands placed on it. Thus, during the treading of the material web by the leader strip, pressure can be exerted on only the section contacted by the leader strip, which in turn results in cost savings and an increase in the process reliability. The pressure acting here generally assumes a value between approximately 1 and 5 bar, preferably between approximately 1.5 and 3 bar. It is to be understood that the sections also have different section widths that preferably lie between approximately 0.7 and 1.5 m. Naturally, the number of blower nozzles per section can also be varied, with 3 to 10 blower nozzles, preferably 4 to 8 blower nozzles, being present in each section.

Another advantageous embodiment of the invention provides for the winding machine to have at least one pressing element that can be placed against the support drum. This achieves the advantage that a self-threading of the leader strip or the material web onto the reel, independent of its current position, can be substantially prevented without impeding the removal of the web from the support drum preceding the reel. With regard to the embodiment of the pressing element, reference is made to the commonly owned unpublished German Patent Application No. 199 07 550.6, which has been expressly incorporated by reference herein in its entirety.

It is to be understood that the above-mentioned features of the invention and those as yet unexplained can be used, not only in the combination indicated, but also in other combinations or by themselves without departing from the scope of the invention.

The present invention is directed to a process for threading a material web onto a reel. The process includes guiding a leader strip of the material web over at least a part of a circumference of a support drum, guiding the leader strip through an effective region of a guide device toward a waste receptacle, widening the leader strip to a desired width of the material web, placing a reel against the support drum, thereby forming a nip, cutting the material web, and winding the material web onto the reel, thereby forming a wound roll.

According to a feature of the instant invention, the reel can include one of an empty reel and a partially wound reel. Further, the material web can include one of a paper and a cardboard web.

In accordance with another feature of the invention, before the leader strip is conveyed to the support drum, the reel may be positioned at a radial distance of at least approximately 1 mm from the support drum.

According to still another feature of the present invention, the effective region can include a contactless region including at least one of at least one air current and at least one water jet. Alternatively, the effective region can include a contact region including at least one of at least one roll and at least one guide belt.

In accordance with a further aspect of the instant invention, the effective region can be arranged to act on only one side of one of the leader strip and the material web.

According to a still further aspect of the invention, the effective region may be arranged to act on both sides of one of the leader strip and the material web.

Further, the effective region may be arranged between n at least two different planes, which are substantially perpendicular to a movement direction of one of the leader strip and the material web. The effective region between the at least two different planes can act on both sides the one of the leader strip and the material web. The two different planes can offset from each other in the movement direction.

According to still another aspect of the instant invention, the process can further include removing the leader strip from the support drum with doctor. The doctor can include least one of a bladed doctor and an air doctor.

In accordance with another aspect of the present invention, the process can further include removing the leader strip from the support drum with an overpressure zone located within the support drum. The support drum can include bores.

In accordance with a further feature of the invention, the widening out of the leader strip to a desired width of the material web can be performed by a point cutter. Further, the desired width of the material web is the entire web width.

Moreover, the cutting of the material web can occur at least one of passively and actively. The passive cutting may include self-cutting by the formation of a loop, and the active cutting may include a gooseneck, an IBS belt, or a water jet.

In accordance with a still further feature of the invention, the cutting of the material web may occur after the material web fulfills at least one of at least one desired quality feature and production feature. The at least one quality feature of the material web can include at least one surface roughness, shrinkage cross-direction profile, and fiber orientation. Further, the at least one production feature of the material web can include at least one of web speed, web width, and production quantity.

Before the leader strip is conveyed to the support drum, the process further can also include moving at least one pressing element against a surface of the support drum. In this manner, the leader strip can be further conveyed between the support drum and the pressing element. In a vicinity of a path of travel of the leader strip over the support drum the effective region is formed as one of a press nip, a press surface, and a blower zone. Further, after the beginning of the winding of the material web onto the reel to form a wound roll, the process may also include moving the pressing element away from the support drum.

The present invention is directed to an apparatus for threading a material web onto a reel. The apparatus includes a support drum adapted to be at least partially wound around by at least a leader strip of the material web, one of a reel and a wound roll positionable against said support drum to form a nip during a winding process, a waste receptacle positioned after the support drum in a web travel direction, and at least one guide device positioned between the support drum and the waste receptacle.

In accordance with a feature of the invention, the reel can include one of an empty reel and a partially wound reel. Further, the material web can be one of a paper and a cardboard web.

According to another aspect of the instant invention, the at least one guide device can be positioned immediately preceding the waste receptacle.

In accordance with an aspect of the present invention, the at least one guide device can have a width of approximately 1000 mm cross-wise to the web travel direction. Further, the at least one guide device can have a width of approximately 750 mm cross-wise to the web travel direction.

According to still another aspect of the invention, the at least one guide device can extend across an entire width of the material web.

In accordance with a further feature of the instant invention, the at least one guide device can include at least one roll pair. The at least one roll pair may include a segmented pair of rolls that is arranged offset relative to each other having a suitable surface quality. At least one roll of the at least one roll pair can include a driven roll.

According to a still further feature of the invention, the at least one guide device can include a roll pair in which at least one roll of the roll pair is a perforated roll adapted to be acted upon by a vacuum. The other of the roll pair can include a rubberized roll.

The at least one guide device may include at least two driven guide belts. The at least one guide belt may have a guide length of between approximately 100 to 500 mm. Further, the at least one guide belt can have a guide length of between approximately 200 to 300 mm. Moreover, the at least one guide belt may have a guide width of between approximately 50 to 100 mm, and preferably between approximately 70 to 80 mm. The at least two belts can be arranged on opposite sides of one of the leader strip and the material web, and each of the at least two belts may include a plurality of adjacent guide belts. A distance between adjacent guide belts is between approximately 20 to 50 mm, and preferably between approximately 25 to 40 mm. The adjacent guide belts can be positionally offset to the adjacent guide belts positioned on the other side of the one of the leader strip and the material web.

In accordance with another feature of the present invention, the at least one guide device can include a guidance system arranged for a fluid to flow therethrough. The guidance system may include outlet openings through which the fluid escapes in the web travel direction. The fluid can be adapted to contact one of the leader strip and the material web. The guidance system may be positioned on both sides of the one of the leader strip and the material web. The outlet openings of the guidance system may be located in different planes oriented substantially perpendicular to the web travel direction. The outlet openings of the guidance system may be adjustable to selectable outlet angles. Further, the fluid can be water. Moreover, the fluid can be air. Still further, a pressure of the fluid flowing through the guidance system is adjustable.

The at least one guide device can include a guide surface formed by an endless belt guided over two rolls. The guide surface, which is adapted to be oriented toward one of the leader strip and the material web, may be acted upon by a vacuum. At least one of the two rolls can be driven. Further, the vacuum may be adjustable.

Moreover, the at least one guide device can include at least one doctor positioned to acts on the support drum. The doctor can include at least one blower nozzle adapted to exerts a pressure on one of the leader strip and the material web. The doctor may have a width of approximately 1000 mm cross-wise to the web travel direction, and preferably approximately 750 mm. The doctor may extend across an entire width of the material web. The doctor can further include a plurality of blower nozzles distributed along its length cross-wise to the web travel direction. The plurality of blower nozzles can be divided into at least two sections, and the plurality of blower nozzles in each of the at least two sections may be acted on with different pressures. The pressure can be between approximately 1 and 5 bar, and preferably between approximately 1.5 and 3 bar.

In accordance with yet another feature of the instant invention, at least one pressing element can be adapted to be placed against the support drum.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIGS. 3A, 3B, 4, 5, 6A, 6B, 7, 8, 9A, and 9B illustrate simplified depictions of exemplary guide devices utilized in accordance with the present invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
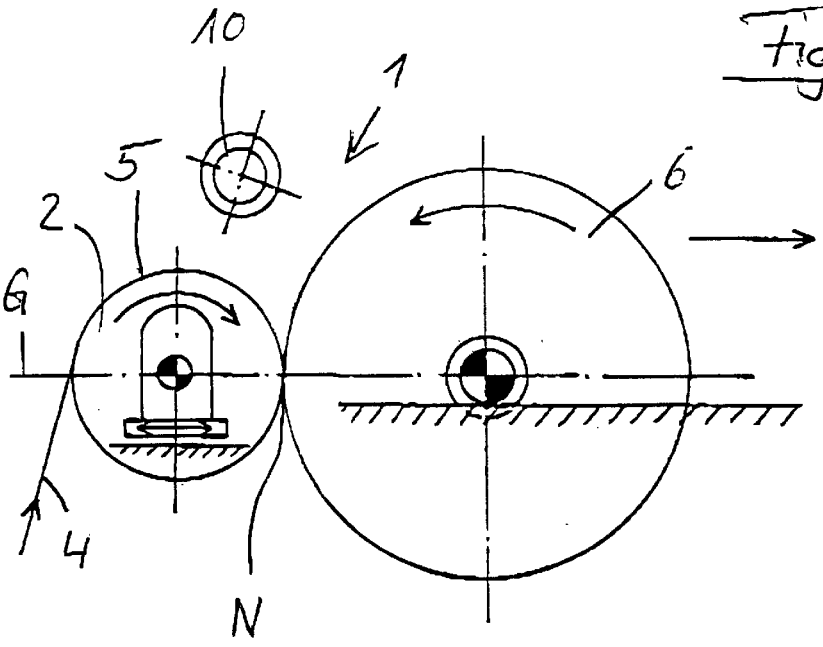
FIG. 1 illustrates a side view of a winding machine during the winding process.

A winding machine 1, which is illustrated in a very schematic form in FIG. 1, includes a support drum 2, i.e., also referred to as a "press drum" or a "support roll," which can be either rigidly supported or moved along an imaginary horizontal line G (shown as a dashed line), by a pressing device (not shown). Further, support drum 2 can be driven by a drive device, e.g., a center drive. Various different bearing types for support drum 2 have in particular been disclosed e.g., in commonly owned unpublished German Patent Application No. DE 198 07 897.8, which is expressly incorporated by reference herein in its entirety. Material web 4 is conveyed either from a calender stack (not shown) or from a drying section (not shown) of a paper or cardboard machine to first wind around a spreader roll (not shown), and then to travel in a direction of the arrow on a circumference surface 5 of support drum 2 for a certain angle ("winding length") to a nip N formed between support drum 2 and wound roll 6. Finally, material web 4 is wound onto wound roll 6. Wound roll 6 can be moved in a direction of the arrow according to (or to compensate for) its diameter increase. The movement device for wound roll 6 is disclosed in the Applicant's above-mentioned commonly owned unpublished German Patent Application No. DE 198 07 897.8. Winding machine 1 can also include another reel 10, e.g., an empty reel, which, after the fulfillment of particular criteria, is placed against support drum 2 to form a nip between support drum 2 and reel 10. A process for a complete reel change is also disclosed in the above-mentioned unpublished German Patent Application No. DE 198 07 897.8.

Figure 2:
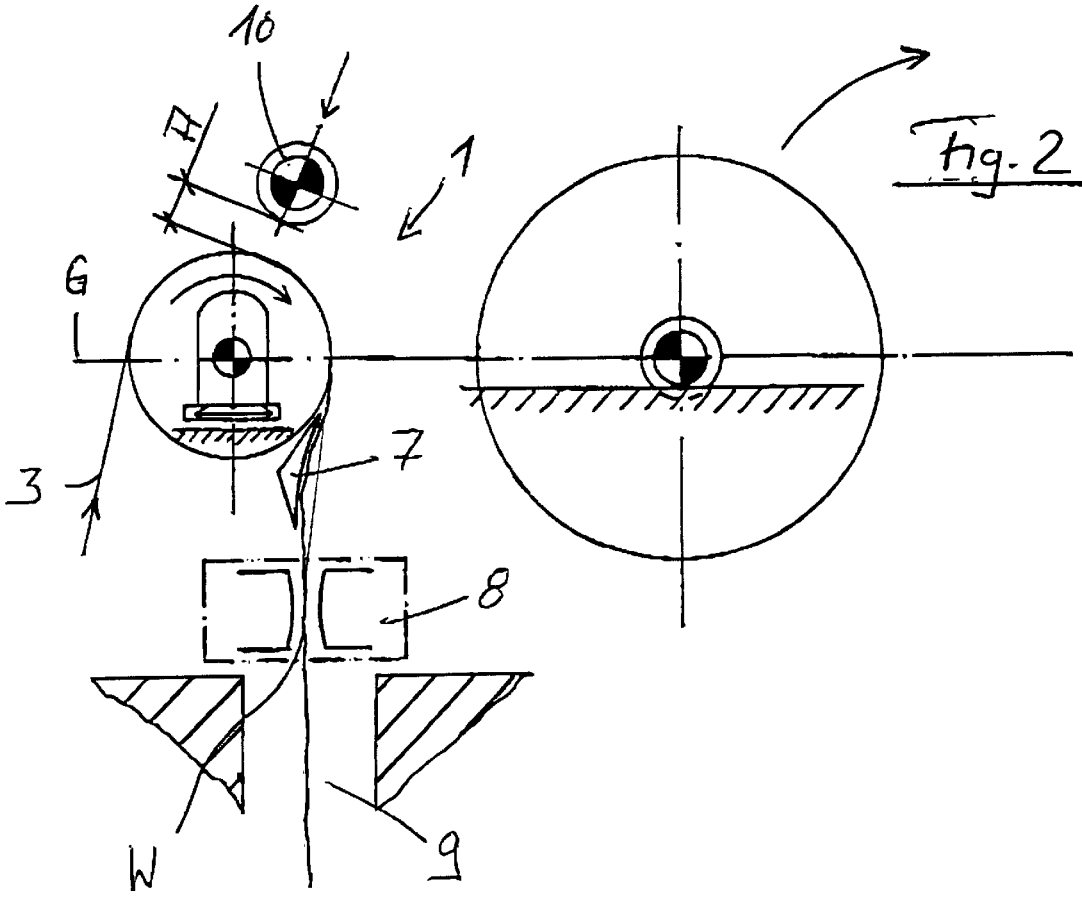
FIG. 2 illustrates a side view of the winding machine depicted in FIG. 1, in which a self-threading of the material web is substantially prevented.

In a very schematic fashion, FIG. 2 illustrates winding machine 1 during a reel change where, in addition to the components shown in FIG. 1, a doctor 7, a guide device 8, and a waste receptacle 9 are depicted in a lower region of winding machine 1.

The function of winding machine 1 and the process according to the present invention for threading a material web, e.g., a paper or cardboard web, onto a reel, such as an empty or partially wound reel, will be explained below in conjunction with a threading process.

A leader strip 3 can be conveyed in a known manner through the regions of the paper or cardboard machine (not shown) via of so-called "traction cables." Before leader strip 3 to be threaded reaches support drum 2, reel 10, which may have already have been rotationally accelerated, can be positioned to provide and/or maintain a radial distance A of at least approximately 1 mm between support drum 2 and reel 10. Leader strip 3 may be conveyed over a part of circumference 5 of support drum 2 and may then be removed from support drum 2 by doctor 7. Leader strip 3, which may then be conveyed to an effective region W of guide device 8 in a direction toward waste receptacle 9, can be widened out to a desired width of material web 4 in a known manner. Thereafter, reel 10 can be placed against support drum 2 and a nip N can then be formed between support drum 2 and reel 10. Finally, material web 4 may be cut and the winding of material web 4 onto reel 10 to form a new wound roll 6 begins.

It is to be understood that in winding machine 1, which is shown in very schematic form in FIG. 2, a partially wound reel 10 could also be wound onto a bearing device (not shown) having a drive mechanism, e.g., a center drive, and may be supported in the extension of horizontal line G. Moreover, the process according to the present invention and the apparatus according to the present invention could also be realized for threading a material web onto partially wound reel 10.

FIGS. 3A, 3B, 4, 5, 6A, 6B, 7, 8, 9A, and 9B illustrate various exemplary embodiments of guide devices utilized in conjunction with the features of the instant invention.

Figure 3A:
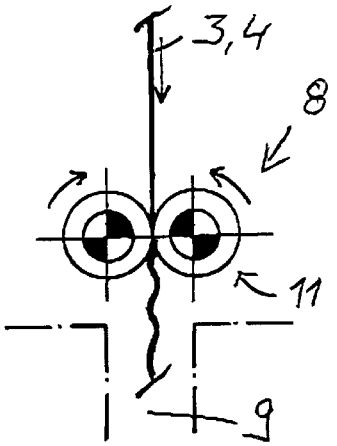
Figure 3B:
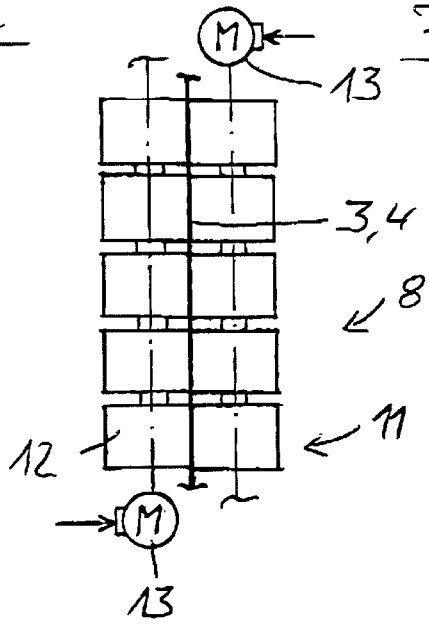

FIG. 3A illustrates a guide device 8 that is disposed above waste receptacle 9 to guide leader strip 3 or material web 4 into waste receptacle 9. Guide device 8 can include a roll pair 11 which may be formed, e.g., as a segmented pair of rolls 11 that are offset relative to each other and haste a suitable surface quality. FIG. 3B illustrates a top view of guide device 8 depicted in FIG. 3A. It is apparent that pair of rolls 11 are arranged in series and rolls 12 of a roll pair 11 of a same guiding side are driven by a common drive device, e.g., an electric motor 18 in conjunction with a control unit.

Figure 4:
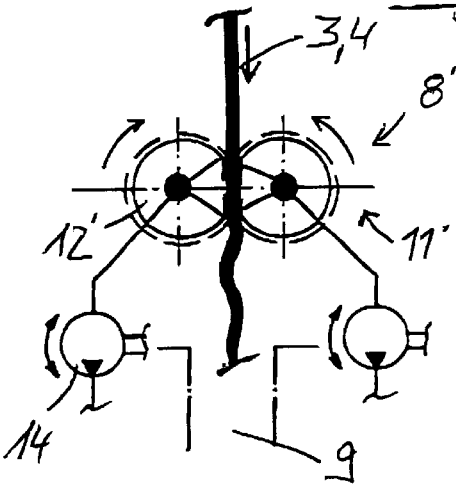
Figure 5:
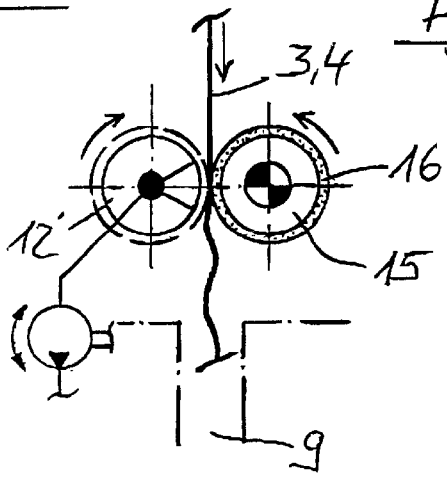

FIG. 4 also depicts a guide device 8, which is located above waste receptacle 9 to convey leader strip 3 or material web 4 into waste receptacle 9. Guide device 8 can include a roll pair 11 with at least one perforated roll 12' which may be acted upon by a vacuum. The adjustable vacuum present in roll 12' can be produced by a vacuum pump 14 and a drive mechanism (not shown), e.g., an electric motor in conjunction with a control unit. In FIG. 4, both rolls 12' can be acted upon by a vacuum. In similarly arranged FIG. 5, roll 12' can be perforated and acted upon by an adjustable vacuum and the other roll 15 can be provided with a rubber cover 16.

In FIG. 6A, guide device 8 may be formed with two driven guide belts 17, each of which is arranged to be guided over two rolls 18 and 19, positioned to form a guide surface 20 for leader strip 3 or material web 4. An outlet side of guide surface 20 can be arranged to face waste receptacle 9. Rolls 19 can be driven by drive mechanisms (not shown), e.g., electric motors in conjunction with control units. FIG. 6B illustrates a sectional view of guide surface 20 depicted in FIG. 6A. Guide surface 20 of guide device 8 can include a plurality of driven guide belts 17, which can be positioned next to one another at a distance S in a cross-wise direction to the movement of leader strip 3 or material web 4. Each guide belt 17 can have a width B and a guide length L located between rolls 18 and 19.

FIG. 7 illustrates guide device 8 as a guidance system 22 through which a fluid 21, e.g., water or air, flows. Guide device 8 can include four guidance systems 22, arranged as guidance system pairs coupled together in series on a same side of leader strip 3 or material web 4, which is being conveyed into waste receptacle 9. The series arrangement of guidance systems 22 are fixed in two parallel planes E and E'. Guidance systems 22 can be provided with outlet openings 23, which can have different outlet sizes for fluid 21 on the side oriented toward leader strip 3 or material web 4. However, it is to be understood that guidance systems 22 can also be arranged offset from each other. An outlet angle a of outlet openings 23 of guidance systems 22 can be individually adjusted. Fluid 21 may be supplied to guidance systems 22 by fluid pumps 24 and associated drive mechanisms (not shown) through hollow bodies 25, such as, pipes or hoses. The speeds of fluid pumps 24 can be individually controlled by a control unit (not shown), i.e., the pressures prevailing in guidance systems 22 and the outlet speeds of fluid 21 from guidance systems 22 can vary within certain limits.

Figure 8:
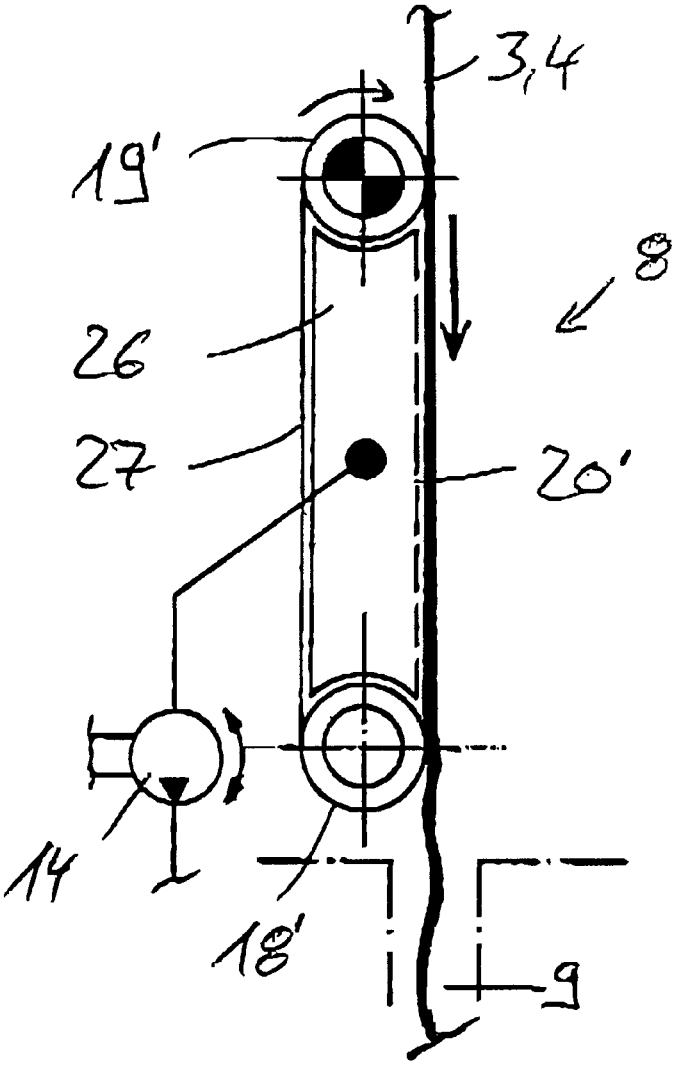

In FIG. 8, guide device 8 may be formed as a guide surface 20', which is formed by an endless belt 27 arranged to travel around rolls 18' and 19' as well as around a suction housing 26. Suction housing 26 can be arranged to act upon guide surface 20', which is oriented toward the leader strip 3 or material web 4. Roll 19 can be driven by a drive mechanism (not shown), e.g., an electric motor in conjunction with a control unit. Moreover, it is further contemplated that roll 18 can be driven, The adjustable pressure prevailing in suction housing 26 may be produced by a vacuum pump 14 and a drive mechanism (not shown), e.g., an electric motor in conjunction with a control unit, Leader strip 3 or material web 4 may be conveyed by belt 27 along guide surface 20 into waste receptacle 9 by the prevailing vacuum.

Figure 9A:
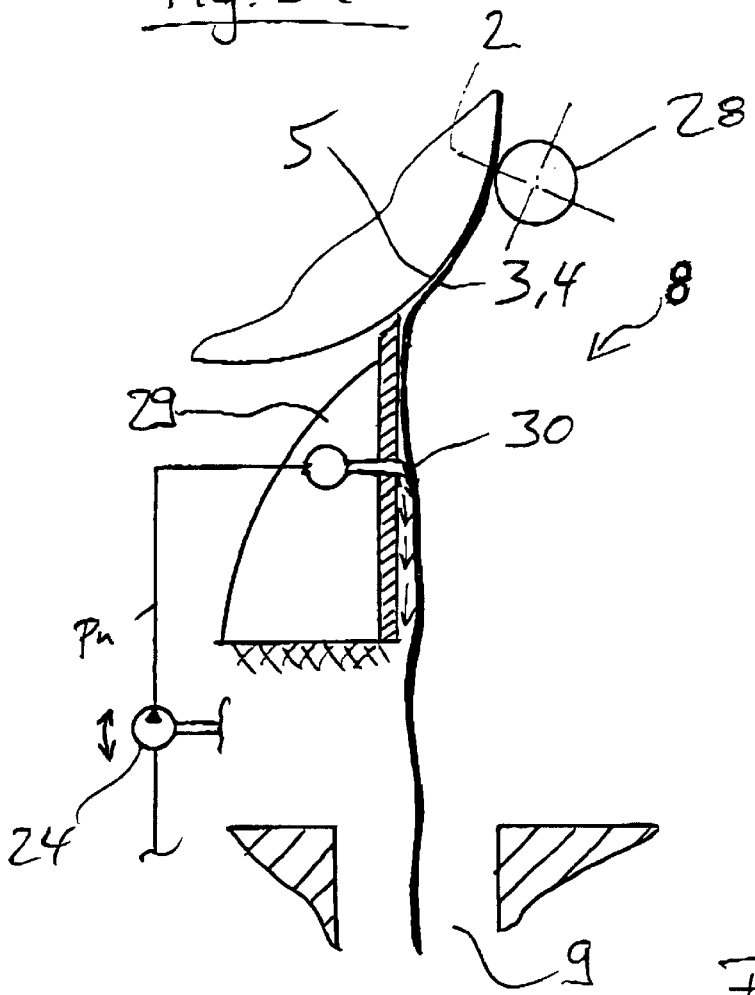
Figure 9B:
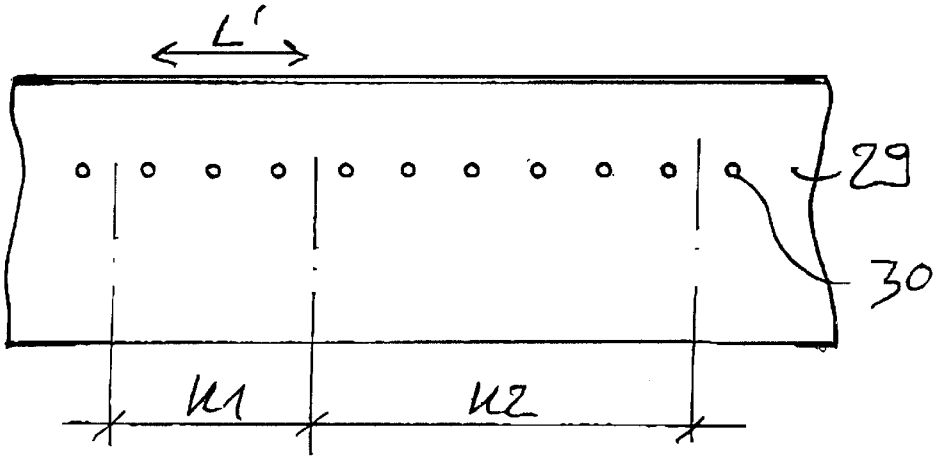

FIG. 9A illustrates a partially depicted support drum 2. Leader strip 3 or material web 4 can be guided over a part of circumference surface 5 of support drum 2. Leader strip 3 or material web 4 can be removed from circumference surface 5 by a doctor 29. On the side facing leader strip 3 or material web 4, doctor 29 can include at least one blower nozzle 30, which acts on leader strip 3 or material web 4 with a pressure $p_n$ produced by fluid pump 24. In this manner, leader strip 3 or material web 4 can be reliably conveyed into waste receptacle 9. As a result, doctor 29 acts as guide device 8 in accordance with the features of the present invention. Doctor 29 can have a width of approximately 1000 mm, preferably of approximately 750 mm, cross-wise to the movement direction of leader strip 3. However, doctor 29 can also extend across an entire width of material web 4. In addition, doctor 29 can include a plurality of blower nozzles 30 distributed along its length L', which can, in turn, be divided into sections K1 and K2 having different widths and different pressures $p_n$. Furthermore, FIG. 9A illustrates a pressing element 28 that can be placed against support drum 2. With regard to the embodiment of pressing element 28, reference is again made to commonly owned unpublished German Patent Application No. 199 07 550.6. FIG. 9B, which illustrates a front view of doctor 29, shows that doctor 29 includes a plurality of blower nozzles 30 distributed along length L', which are divided into sections K1 and K2.

The specifically identified exemplary embodiments of guide devices mentioned above merely represent a selection of possible guide devices.

It should be emphasized that the present invention provides a process and a apparatus for threading a material web onto a reel with which the leader strip or the material web is first reliably conveyed into the waste receptacle and a self-threading of the leader strip or the material web onto the reel, independent of its current position, is substantially prevented without impeding the removal of the web from the support drum preceding the reel.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

1 winding machine
2 support drum
3 leader strip
4 material web
5 circumference surface
6 wound roll
7, 29 doctor
8 guide device
9 waste receptacle
10 reel
11 roll pair
12 roll
13 electric motor
14 vacuum pump
15 roll
16 rubber cover
17 guide belt
18 roll
19 driven roll
20 guide surface
21 fluid
22 guidance system
23 outlet opening
24 fluid pump
25 hollow body
26 suction housing
27 belt
28 pressing element
30 blower nozzle
A radial distance
B guide width
E plane
K1, K2 section
L guide length
L' length
N nip
$P_n$ pressure
S distance
W effective region
a outlet angle

What is claimed:

1. A process for threading a material web onto a reel comprising:

guiding a leader strip of the material web over at least a part of a circumference of a support drum;

guiding the leader strip through an effective region of a guide device toward a waste receptacle;

widening the leader strip to a desired width of the material web;

placing a reel against the support drum, thereby forming a nip;

cutting the material web; and winding the material web onto the reel, thereby forming a wound roll.

2. The process according to claim 1, wherein the reel comprises one of an empty reel and a partially wound reel.

3. The process according to claim 2, wherein the material web comprises one of a paper and a cardboard web.

4. The process according to claim 1, wherein, before the leader strip is conveyed to the support drum, the reel is positioned at a radial distance of at least approximately 1 mm from the support drum.

5. The process according to claim 1, further comprising removing the leader strip from the support drum with an overpressure zone located within the support drum, wherein the support drum includes bores.

6. The process according to claim 1, wherein the effective region comprises a contact region including at least one of at least one roll and at least one guide belt.

7. The process according to claim 1, wherein the effective region is arranged to act on only one side of one of the leader strip and the material web.

8. The process according to claim 1, wherein the widening out of the leader strip to a desired width of the material web is performed by a point cutter.

9. The process according to claim 1, wherein the desired width of the material web is the entire web width.

10. The process according to claim 1, further comprising removing the leader strip from the support drum with a doctor.

11. The process according to claim 10, wherein the doctor comprises at least one of a bladed doctor and an air doctor.

12. The process according to claim 1, wherein the cutting of the material web occurs at least one of passively and actively.

13. The process according to claim 12, wherein the passive cutting includes self-cutting by the formation of a loop, and the active cutting includes a gooseneck, an IBS belt, or a water jet.

14. The process according to claim 1, wherein the cutting of the material web occurs after the material web fulfills at least one of at least one desired quality feature and production feature.

15. The process according to claim 14, wherein the at least one quality feature of the material web includes at least one surface roughness, shrinkage cross-direction profile, and fiber orientation.

16. The process according to claim 14, wherein the at least one production feature of the material web includes at least one of web speed, web width, and production quantity.

17. The process according to claim 1, wherein, before the leader strip is conveyed to the support drum, the process further comprises moving at least one pressing element against a surface of the support drum, whereby the leader strip is further conveyed between the support drum and the pressing element.

18. The process according to claim 17, wherein in a vicinity of a path of travel of the leader strip over the support drum the effective region is formed as one of a press nip, a press surface, and a blower zone.

19. The process according to claim 18, wherein, after the beginning of the winding of the material web onto the reel to form a wound roll, the process further comprises moving the pressing element away from the support drum.

20. An apparatus for threading a material web onto a reel comprising:

a support drum structured and arranged to be at least partially wound around by at least a leader strip of the material web;

one of a reel and a wound roll positionable against said support drum to form a nip during a winding process;

a waste receptacle positioned after said support drum in a web travel direction;

at least one guide device positioned between said support drum and said waste receptacle.

21. The apparatus according to claim 20, wherein said reel comprises one of an empty reel and a partially wound reel.

22. The apparatus according to claim 21, wherein the material web comprises one of a paper and a cardboard web.

23. The apparatus according to claim 20, wherein said at least one guide device is positioned immediately preceding said waste receptacle.

24. The apparatus according to claim 20, wherein said at least one guide device has a width of approximately 1000 mm cross-wise to the web travel direction.

25. The apparatus according to claim 24, wherein said at least one guide device has a width of approximately 750 mm cross-wise to the web travel direction.

26. The apparatus according to claim 20, wherein said at least one guide device extends across an entire width of the material web.

27. The apparatus according to claim 20, wherein said at least one guide device comprises a guide surface formed by an endless belt guided over two rolls, and wherein said guide surface, which is structured and arranged to be oriented toward one of the leader strip and the material web, is acted upon by a vacuum.

28. The apparatus according to claim 27, wherein said vacuum is adjustable.

29. The apparatus according to claim 27, wherein at least one of said two rolls is driven.

30. The apparatus according to claim 20, wherein said at least one guide device comprises at least one doctor positioned to acts on said support drum, said doctor comprising at least one blower nozzle structured and arranged to exerts a pressure on one of the leader strip and the material web.

31. The apparatus according to claim 30, wherein said doctor has a width of approximately 1000 mm cross-wise to the web travel direction.

32. The apparatus according to claim 31, wherein said doctor has a width of approximately 750 mm cross-wise to the web travel direction.

33. The apparatus according to claim 30, wherein said doctor extends across an entire width of the material web.

34. The apparatus according to claim 30, wherein said doctor further comprises a plurality of blower nozzles distributed along its length cross-wise to the web travel direction.

35. The apparatus according to claim 34, wherein said plurality of blower nozzles are divided into at least two sections.

36. The apparatus according to claim 35, wherein said plurality of blower nozzles in each of said at least two sections are acted on with different pressures.

37. The apparatus according to claim 30, wherein said pressure is between approximately 1 and 5 bar.

38. The apparatus according to claim 37, wherein said pressure is between approximately 1.5 and 3 bar.

39. The apparatus according to claim 20, further comprising at least one pressing element structured and arranged to be placed against the support drum.

40. The process according to claim 1, wherein the effective region comprises a contactless region including at least one of at least one air current and at least one water jet.

41. The process according to claim 1, wherein the effective region is arranged to act on both sides of one of the leader strip and the material web.

42. The process according to claim 1, wherein the effective region is arranged between at least two different planes, which are substantially perpendicular to a movement direction of one of the leader strip and material web.

43. The process according to claim 42, wherein the effective region between the at least two different planes acts on both sides the one of the leader strip and the material web, wherein the two different planes are offset from each other in the movement direction.

44. The apparatus according to claim 20, wherein said at least one guide device comprises at least one roll pair.

45. The apparatus according to claim 44, wherein said at least one roll pair comprises a segmented pair of rolls that are arranged offset relative to each other having a suitable surface quality.

46. The apparatus according to claim 45, wherein at least one roll of said at least one roll pair comprises a driven roll.

47. The apparatus according to claim 20, wherein said at least one guide device comprises a roll pair in which at least one roll of said roll pair is a perforated roll adapted to be acted upon by a vacuum.

48. The apparatus according to claim 47, wherein the other of said roll pair comprises a rubberized roll.

49. The apparatus according to claim 20, wherein said at least one guide device comprises at least two driven guide belts.

50. The apparatus according to claim 49, wherein said at least one guide belt has a guide length of between approximately 100 to 500 mm.

51. The apparatus according to claim 50, wherein said at least one guide belt has a guide length of between approximately 200 to 300 mm.

52. The apparatus according to claim 49, wherein said at least one guide belt has a guide width of between approximately 50 to 100 mm.

53. The apparatus according to claim 52, wherein said at least one guide belt has a guide width of between approximately 70 to 80 mm.

54. The apparatus according to claim 49, wherein said at least two belts are arranged on opposite sides of one of the leader strip and the material web, and each of said at least two belts comprises a plurality of adjacent guide belts, and wherein a distance between adjacent guide belts is between approximately 20 to 50 mm.

55. The apparatus according to claim 54, wherein a distance between adjacent guide belts is between approximately 25 to 40 mm.

56. The apparatus according to claim 54, wherein said adjacent guide belts are positionally offset to said adjacent guide belts positioned on the other side of the one of the leader strip and the material web.

57. The apparatus according to claim 20, wherein said at least one guide device comprises a guidance system arranged for a fluid to flow therethrough, said guidance system including outlet openings through which said fluid escapes in the web travel direction.

58. The apparatus according to claim 57, wherein said fluid is adapted to contact one of the leader strip and the material web.

59. The apparatus according to claim 57, wherein said guidance system is positioned on both sides of the one of the leader strip and the material web.

60. The apparatus according to claim 59, wherein said outlet openings of said guidance system are located in different planes oriented substantially perpendicular to the web travel direction.

61. The apparatus according to claim 57, wherein said outlet opening of said guidance system are adjustable to selectable outlet angles.

62. The apparatus according to claim 57, wherein said fluid is water.

63. The apparatus according to claim 57, wherein said fluid is air.

64. The apparatus according to claim 63, wherein a pressure of said fluid flowing through said guidance system is adjustable.

* * * * *